US007913606B2

(12) United States Patent
Schneider et al.

(10) Patent No.: US 7,913,606 B2
(45) Date of Patent: Mar. 29, 2011

(54) INDUCTIVE POWER TRANSFER

(75) Inventors: Arthur J. Schneider, Tucson, AZ (US); Andrew J. Hinsdale, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 687 days.

(21) Appl. No.: 11/867,098

(22) Filed: Oct. 4, 2007

(65) Prior Publication Data

US 2011/0041674 A1 Feb. 24, 2011

Related U.S. Application Data

(60) Provisional application No. 60/828,197, filed on Oct. 4, 2006.

(51) Int. Cl.
*F42C 17/04* (2006.01)

(52) U.S. Cl. ..... 89/6.5

(58) Field of Classification Search ..... 89/6, 6.5, 89/1.811
See application file for complete search history.

(56) References Cited

U.S. PATENT DOCUMENTS

| | | | | |
|---|---|---|---|---|
| 4,142,442 | A * | 3/1979 | Tuten | 89/6.5 |
| 4,649,796 | A * | 3/1987 | Schmidt | 89/6.5 |
| 6,176,168 | B1 * | 1/2001 | Keil et al. | 89/6.5 |
| 7,190,304 | B1 * | 3/2007 | Carlson | 342/62 |
| 2003/0221546 | A1 | 12/2003 | Adams et al. | |
| 2005/0061191 | A1 | 3/2005 | Dietrich et al. | |
| 2005/0126379 | A1 * | 6/2005 | Pikus et al. | 89/6 |

* cited by examiner

*Primary Examiner* — Stephen M Johnson
(74) *Attorney, Agent, or Firm* — Schwegman, Lundberg & Woessner, P.A.; Gregory J. Gorrie

(57) ABSTRACT

The present invention generally concerns inductive power transfer systems and their components. More particularly, representative and exemplary embodiments of the present invention generally relate to systems, devices and methods for transferring modulated current between a launcher and at least one guided missile.

9 Claims, 2 Drawing Sheets

INDUCTIVE POWER TRANSFER

RELATED APPLICATIONS

This application claims the benefit of U.S. Provisional Patent Application Ser. No. 60/828,197 filed in the United States Patent and Trademark Office on Oct. 4, 2006.

FIELD OF INVENTION

The present invention generally concerns inductive power transfer systems and their components. More particularly, representative and exemplary embodiments of the present invention generally relate to systems, devices and methods for transferring modulated current between a launcher and at least one guided missile.

BACKGROUND OF THE INVENTION

Over the past decade, modern air forces have been transforming their operational concepts to effects-oriented planning. In other words, there has been a shift from focusing on the number of aircraft required to destroy a single target, to the number of targets which may be destroyed with a single aircraft and the aggregated effect such attacks could yield. This change in methodology has led to the development of more sophisticated armaments. Accordingly, munitions manufacturers have attempted to keep pace by continuously advancing the field of guided missile weapons systems. These munitions must meet strict specification requirements and deliver dependable lethality.

Missile guidance solutions use a variety of technologies to guide the missile to an intended target. These can generally be classified into a number of categories, most notably: active, passive, and present. Passive systems generally use signals generated by the target. The most common of these are sound and infrared. Active systems typically require an input signal to guide them to an intended target. One common sort of signal is a controller who watches the missile and sends corrections to its flight path. Other techniques may involve using radar or radio control. New technologies are advancing active systems to fire-and-forget and beyond status.

Existing systems may be used to attack targets at fixed locations with increasingly complex techniques for guidance ranging from line-of-sight to GPS, and generally use fixed positions (e.g., stars) for augmented navigational control. These techniques have farther-reaching communication capabilities and increased navigational control. Accordingly, there is a need for new data transfer methods and processes to accommodate these emerging technologies.

SUMMARY OF THE INVENTION

In various representative aspects, the present invention provides a design for an inductive power transfer device for use in a weapon system. Advantages of the present invention will be set forth in the Detailed Description which follows, and may be apparent from the Detailed Description or may be learned by practice of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside in the details of construction and operation as more fully hereafter depicted, described or otherwise identified—reference being made to the accompanying drawings, images, figures, etc. forming a part hereof, wherein like numerals (if any) refer to like parts throughout. Other elements, operational features, applications and/or advantages may be implemented in light of certain exemplary embodiments recited, wherein.

Elements in the figures, drawings, images, etc. are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like, are used for distinguishing between similar elements and not necessarily for describing a sequential or chronological order. Moreover, the terms 'front', 'back', 'top', 'bottom', 'over', 'under', and the like in the disclosure and/or in the claims, are generally employed for descriptive purposes and not necessarily for comprehensively describing exclusive relative position. Any of the preceding terms so used may be interchanged under appropriate circumstances such that various embodiments of the invention, for example, may be capable of operation in other configurations and/or orientations than those explicitly illustrated or otherwise described.

DETAILED DESCRIPTION OF EXEMPLARY EMBODIMENTS

The descriptions contained herein are of exemplary embodiments of the invention and the inventors' conception of the best mode and are not intended to limit the scope, applicability or configuration of the invention in any way. Rather, the following description is intended to provide convenient illustrations for implementing various embodiments of the invention. Changes may be made in the function and/or arrangement of any of the elements described in the disclosed exemplary embodiments without departing from the spirit and scope of the invention.

Methods and devices according to various aspects of the present invention generally provide inductive air gap transformer power transfer systems. Various representative implementations of the present invention may be applied to any inductive power transfer system. Certain representative implementations may include, for example: an inductive power transfer system suitably sized for any launcher dimension; transformer windings made out of any suitable material; various winding element designs; and/or the like. The present invention may provide a primary communication method or may be utilized as a stand-alone or as one of many secondary communication devices. The present invention may provide a primary power delivery method or may be utilized as a stand-alone or as one of many secondary power devices.

A detailed description of an exemplary application, namely an inductive transfer system suitably configured for use with a helicopter based Advance Precision Kill Weapons System (APKWS) type guided missile, is provided as a specific enabling disclosure that may be generalized to any application of the disclosed system and method for inducing a charge on munitions in accordance with various embodiments of the present invention.

Figure 1A:
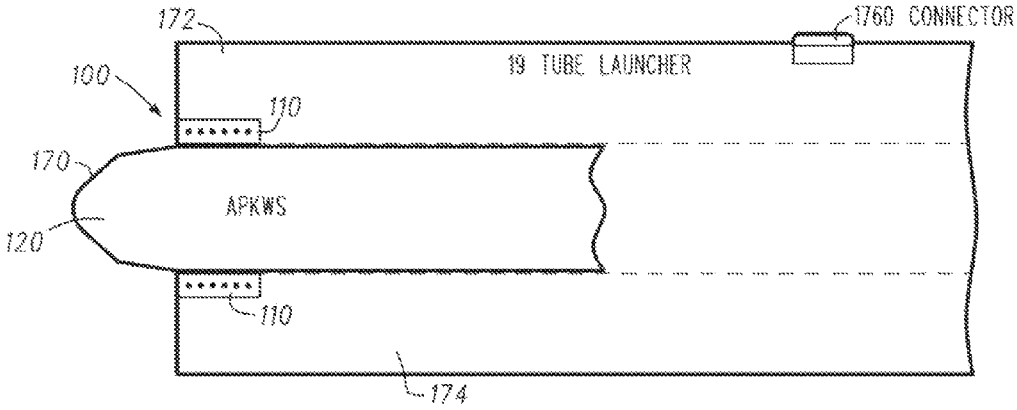
FIGS. 1A and 1B representatively illustrate an inductive transfer system in accordance with an exemplary embodiment of the present invention.

For example, referring to FIG. 1A, in one embodiment in accordance with various aspects of the present invention, inductive transfer system 100 may comprise a launcher winding 110, a projectile winding 120, an operations system 130, and a control system 140. Launcher winding 110 may be disposed circumferentially, perpendicular to the horizontal axis of the launcher 102 so that launcher winding 110 suitably forms an air gap transformer with the projectile winding 120. This positioning may be at any point along the horizontal axis of the launcher 102. Launcher winding 110 may be coupled to the exterior of the launcher 102 or may be fabricated within the launcher body. Launcher winding 110 may be coupled to the exterior of the launcher 102 in any manner, whether now known or hereafter described in the art. Launcher winding 110 may be constructed out of any suitable material and may be suitably configured or adapted for any number of missile launcher tubes. Launcher winding 110 may be electrically coupled to operations system 130, the weapons data system of the launcher 160, and a power source 150. Projectile winding 120 may be electrically coupled to a supercapacitor 105 to store current for later use.

In a representative embodiment, launcher winding 110 may be suitably coupled to the exterior of the launcher 102 by a circumferential strap. This mounting generally does not inhibit the traditional operational function of the missile launcher. Additionally, this method would generally require no further modifications to the existing launcher platform. The disclosed method is suitably robust to withstand various environments that the launcher 102 will experience. In an exemplary representative embodiment illustrated in FIG. 1B, launcher winding 110 may be configured for a nineteen (19) tube launcher 174. Additionally, launcher winding 110 may be located towards the projectile exit point of the launcher.

In another representative embodiment, launcher winding 110 may be coupled to a power source of a helicopter. Launcher winding 110 will generally be electrically connected to the 1760 data bus of the helicopter at the suspension point of the launcher. The 1760 connection typically provides a power source and facilitates data transmission. In another representative embodiment, launcher winding 110 may include, for example, a 20 turn coil capable of transmitting 20 watts when driven by a 30 KHz current.

Operations system 130 may be configured to be responsible for modulating the current induced in the projectile winding 120 from the launcher winding 110 for data and power transferring purposes. Operations system 130 may include a memory capable of storing information transferred from the control system 140 along with preprogrammed commands. Operations system 130 may be coupled to the weapons data system of the launcher. This communication link will generally facilitate the transmission of data pertinent to launching the projectile. Representative data may include, but will not be limited to: targeting information, guidance information, and status checks. Data is typically communicated through modulated induced current. Additionally, operations system 130 may be coupled to sensors 132 and other targeting equipment.

In a representative and exemplary embodiment, operations system 130 may be coupled to a command system of the helicopter. In another embodiment, operations system 130 typically includes a memory capable of storing preprogrammed standards and data transmitted by the control system 140 or the weapons data system. In another embodiment, operations system 130 may be coupled to a laser seeker 128 mounted in the forward portion of the missile 126.

Control system 140 may be configured to receive data from and transmit responses to operations system 130. Control system 140 generally performs status checks and modulates and transfers current and data through the projectile winding 120 and the launcher winding 110 to operations system 130. Control system 140 may include a memory capable of storing information transferred from the operations system 130 along with preprogrammed commands. Control system 140 will generally be electrically coupled to the projectile.

In another embodiment, control system 140 may be located within the projectile body. Data sent from the control system 140 to operations system 130 will typically include, but will not be limited to, responses to projectile status and BIT check inquires. In a further embodiment, control system 140 and operations system 130 may be implemented in a single processing device to allow for omnidirectional modulation of induced current between the launcher winding 110 and the projectile winding 120.

Figure 2:
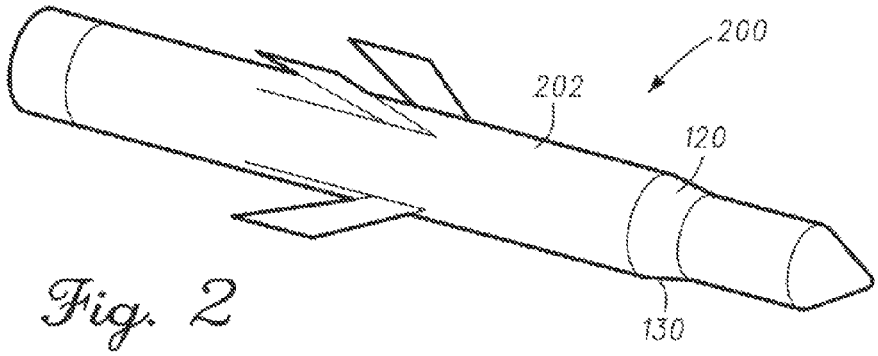
FIG. 2 representatively illustrates an isometric perspective view of a projectile in accordance with an exemplary embodiment of the present invention.

Referring now to FIG. 2, in another embodiment in accordance with various aspects of the present invention, projectile winding 120 may be coupled to or located on or within a projectile 200. This may provide suitable external attachment to the projectile 200 or may be located within the projectile body 202. Projectile winding 120 will ordinarily travel a partial or complete circumference about the projectile body. Projectile winding 120 may be suitably positioned within the launcher body so that projectile winding 120 forms an air gap transformer with launcher winding 110. Projectile winding 120 may be constructed of any suitable material to create a suitable transformer. The axis of projectile winding 120 may be oriented about, and may be positioned approximately parallel to, the axis corresponding to the disposition of the orientation of launcher winding 110. Projectile winding 120 may be electrically connected to a device capable of storing an induced charge and electrically connected to control system 140.

Figure 1B:
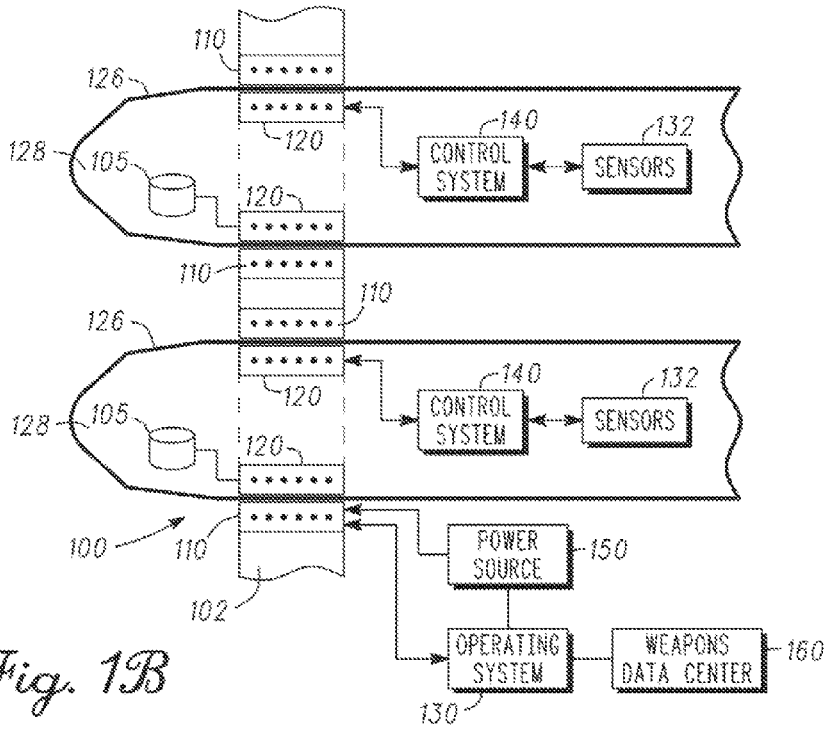

In the representative exemplary embodiment illustrated in FIG. 1B, projectile winding 120 may be mounted within the front section 172 of the APKWS guided missile body 170. A 30 KHz current generated in the missile may be employed to transmit data to the operations system 130 from projectile winding 120 to launcher winding 110 using modulated current. In this embodiment, projectile winding 120 may be electrically coupled to a supercapacitor to store current for later use.

Inductive transfer system 100 may be located on any vehicle launcher or standalone guided missile launcher. These may include, but are not limited to: air vehicles, water craft, land vehicles, stationary launchers, mobile shoulder-fired weapons, and/or the like. The complexity of the weapons data system may correspond, in proportion, to the sophistication of the launching device.

In a representative embodiment, inductive transfer system 100 may be operated from the cockpit of a helicopter through a connection to the helicopter's 1760 system. This data transfer function generally allows for lock-on-before-launch and other targeting system data transfers. The inductive system 100 generally allows munitions to experience real time induction data transfers. Additionally, the inductive power transfer may occur at any time prior to projectile launch. This generally eliminates the step of inducing a current on the projectile external to the launcher prior to loading the munitions.

Figure 3:
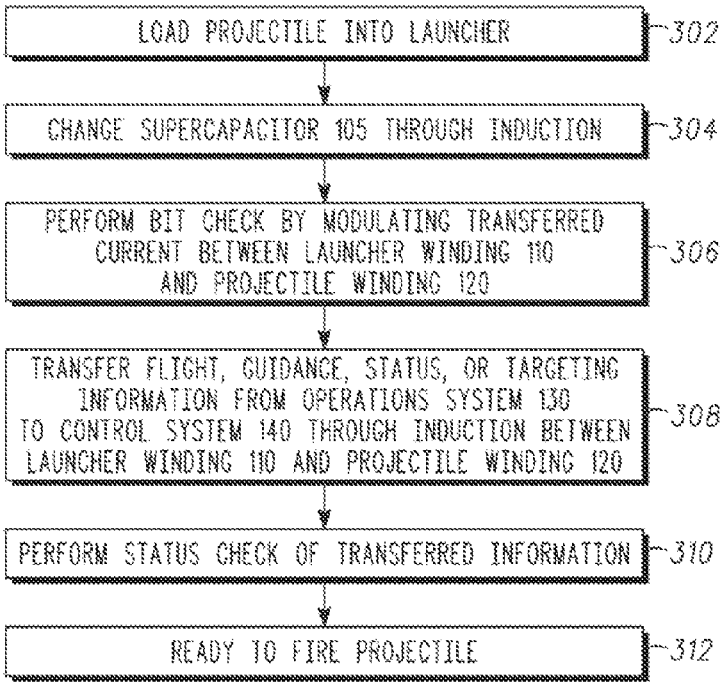
FIG. 3 representatively illustrates an operational flowchart in accordance with an exemplary embodiment of the present invention.

Referring to FIG. 3, in a representative embodiment, a missile fitted with an internal projectile winding 120 may be loaded into a launcher adapted with a launcher winding 110 in operation 302. In operation 304, the missile's internal supercapacitor 105 may be charged through induction by the induction transformer created between the projectile winding 120 and the launcher winding 110. The projectile winding 120 and the launcher winding 110 of the transformer are generally electrically isolated from each other. The transfer of energy generally takes place by electromagnetic coupling through a process known as mutual induction. In operation 306, a bit check is performed by modulating transferred current between the launcher winding 110 and the projectile winding 120.

In operation 308, the current may be modulated by the operations system 130 and the control system 140 as needed to suitably transmit data. This data may comprise at least one of: flight information, targeting information, missile status information, guidance information, and/or the like. In operation 310, a status check of the transferred information may be performed and in operation 312, the projectile may be ready to be fired.

The current sent through induction from the launcher winding 110 to the projectile winding 120 may be supplied from the 1760 data and power system of the helicopter. The current sent from the projectile winding 120 to the launcher winding 110 may be delivered from the supercapacitor 105 located within the projectile body. This process may generally be repeated for any number of projectiles housed within the launcher. A plurality of projectiles may be charged at once, or discrete projectiles may be charged individually. Power source constraints may determine how many projectiles may be charged simultaneously. In a representative exemplary embodiment, utilizing an adapted nineteen (19) tube launcher 174, two charging sessions may be preformed, though more or less sessions could be preformed, if all tubes on the launcher were loaded.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one, and all such modifications are intended to be included within the scope of the present invention. Accordingly, the scope of the invention should be determined by the claims appended hereto and their legal equivalents, rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages, and solutions to problems have been described above with regard to particular embodiments; however, any benefit, advantage, solution to problem, or any element that may cause any particular benefit, advantage or solution to occur or to become more pronounced are not to be construed as critical, required or essential features or components of any or all the claims.

As used herein, the terms "comprising", "having", "including", or any contextual variant thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. An inductive transfer system configured to transfer power and data including guidance data, targeting information and flight information to one or more of a plurality of guided projectiles mounted in launch tubes on a helicopter, comprising:

a projectile launcher body;

a launcher winding mounted on the projectile launcher body;

an operations mechanism for modulating and transmitting current electrically connected to the launcher winding; and at least one guided projectile located within the projectile launcher body, said guided projectile comprising:

at least one projectile winding magnetically coupled to the launcher winding; and a control mechanism for receiving data from the operations mechanism electrically coupled to the projectile winding, wherein the projectile launcher body comprises a tube launcher having a 1760 connection, and wherein the data is transferred from a 1760 bus of the helicopter coupled to the 1760 connection through the launcher winding and the projectile winding to the control mechanism to provide a lock-on-before-launch data transfer.

2. The inductive transfer system according to claim 1, wherein the projectile winding is configured to have an approximately parallel axial orientation with respect to orientation of the launcher winding.

3. The inductive transfer system according to claim 2, wherein the projectile winding forms an air coil transformer.

4. The inductive transfer system according to claim 3, wherein the launcher winding is mounted circumferentially on the launcher.

5. The inductive transfer system according to claim 4, wherein the current in the projectile winding is stored in a capacitor housed within the projectile.

6. The inductive transfer system according to claim 5, wherein the operations mechanism transmits data by modulating the current induced in the projectile winding.

7. The inductive transfer system according to claim 6, wherein the data further comprises status information.

8. The inductive transfer system according to claim 7, wherein the control mechanism transmits data to the operations mechanism by modulating the current induced in the launcher winding in response to a signal.

9. A guided projectile launching system for a helicopter comprising a plurality of launch tubes, each launch tube configured to include a guided projectile, each launch tube having a 1760 connection for coupling with a 1760 bus of the helicopter, wherein each launching tube comprises a launcher winding within the launching tube, wherein each guided projectile comprises a projectile winding within a front section of the guided projectile and a control system, wherein the guided projectile launching system comprises an operating system to inductively transfer power and data across the launcher windings to the projectile windings to configure the control systems of the guided projectiles, and wherein the data includes guidance data and targeting information to provide a lock-on-before-launch capability.

* * * * *